US007124620B2

(12) United States Patent
Venäläinen

(10) Patent No.: US 7,124,620 B2
(45) Date of Patent: Oct. 24, 2006

(54) APPARATUS IN THE STRAIGHTENING BENCH OF THE CAR BODY

(75) Inventor: Olavi Venäläinen, Kuopio (FI)

(73) Assignee: Autorobot Finland Oy, Kuopio (FI)

( * ) Notice: Subject to any disclaimer, the term of this patent is extended or adjusted under 35 U.S.C. 154(b) by 0 days.

(21) Appl. No.: 11/209,457

(22) Filed: Aug. 22, 2005

(65) Prior Publication Data

US 2006/0010958 A1 Jan. 19, 2006

Related U.S. Application Data

(63) Continuation of application No. PCT/FI2004/000094.

(30) Foreign Application Priority Data

Feb. 26, 2003 (FI) ..... 20030284

(51) Int. Cl.
*B21J 13/08* (2006.01)

(52) U.S. Cl. ..... 72/457; 72/705

(58) Field of Classification Search ..... 72/446, 72/447, 453.01, 457, 705
See application file for complete search history.

(56) References Cited

U.S. PATENT DOCUMENTS 4,023,394 A 5/1977 Borup ..... 72/457
4,242,803 A 1/1981 Dory ..... 33/288
4,823,589 A 4/1989 Maxwell, Jr. et al. ..... 72/457
4,848,136 A 7/1989 Venäläinen ..... 72/447
5,186,038 A * 2/1993 Venalainen ..... 72/457
5,253,509 A * 10/1993 Venalainen ..... 72/457
5,533,378 A * 7/1996 Boeck et al. ..... 72/302
5,644,946 A * 7/1997 Weschler ..... 72/457
5,910,186 A * 6/1999 Weschler ..... 72/447

* cited by examiner

*Primary Examiner*—Ed Tolan
(74) *Attorney, Agent, or Firm*—Harrington & Smith, LLP

(57) ABSTRACT

The object of the invention is an apparatus in the straightening bench of the car body, which straightening bench includes a straightening table and a set of frame beams, attaching elements for attaching the car to the set of frame beams, at least a part of which attaching elements have been attached movably to the set of frame beams for attaching cars of various sizes to the straightening table. The apparatus in accordance with the invention includes a transfer beam to be attached movably to the frame beam of the straightening table, to which transfer beam a part of the attaching elements are attached, locking elements for attaching the transfer beam removably to the frame beam and a transfer device for transferring the transfer beam in regard to the frame beam.

7 Claims, 2 Drawing Sheets

APPARATUS IN THE STRAIGHTENING BENCH OF THE CAR BODY

This application is a continuation of International Patent Application No. PCT/FI2004/000094 filed Feb. 25, 2004.

The present invention relates to an apparatus in the straightening bench of the car body, which straightening bench comprises a straightening table of a car body and a set of frame beams, attaching elements for attaching the car to the set of frame beams, at least part of which attaching elements are attached movably to the set of frame beams for attaching cars of various sizes to the straightening table.

BACKGROUND OF THE INVENTION

In crash repairs of cars, various kinds of straightening devices are used for straightening of car bodies and other parts. Usually these devices comprise of a set of frame beams or similar to which the body of a car is attached before taking measures in straightening of the car body. There are attaching elements or similar attached to the set of frame beams in order to attach the car body to it. There are attaching points in cars at certain points to which these attaching elements may be attached. In various cars these attaching points may be placed at various distances from each other while cars are of different sizes and these points and their location depends on the manufacturer. Therefore, it is usual that at least part of the attaching elements are removable, in other words, they may be removed to desired place. In this case, the car is transferred on a straightening table such that the fixed attaching elements on the straightening table are placed at the point of the attaching points of the car and the fixed attaching elements are attached to these attaching points. Next the removable attaching elements are moved such that they are placed at the point of the attaching points of the car and they are attached to those.

There are several disadvantages connected to the present practice. Removable attaching elements are usually heavy and force is needed to move them. They are located inconveniently under the car and the straightening table may not be lifted before attaching, which makes the working position uncomfortable. Furthermore, there is a problem because adjusting, moving and attaching takes relatively much working time.

The object of the invention is to provide an apparatus with the use of which the earlier mentioned disadvantages are eliminated. Especially the object of the invention is to provide an apparatus, in the use of which the working position is ergonomically suitable, the mounting relatively easy and with the use of which notable time saving is achieved. In addition, the object of the invention is to provide an apparatus, which may also be used in the straightening work of a car itself.

DESCRIPTION OF THE INVENTION

The apparatus in accordance with the invention comprises a transfer beam to be attached movably to the frame beam of the straightening table, to which trancfer beam a part of the attaching elements are attached, locking elements for attaching the transfer beam removably to the frame beam and a transfer device for transferring the transfer beam in regard to the frame beam. The apparatus is easy to use; the transfer beam and attaching elements attached to it may be moved by means of the transferring device and transfer in regard to the frame beam while the locking device has been unlocked. In this way, the attaching elements may be transferred to the desired point of the car on the straightening table that is to the points of the attaching points of the car. After this, the transfer beam with attaching elements is attached to the frame beam by means of the locking elements and the attaching elements are attached to the car. A worker does not have to physically move heavy attaching elements from one place to another in an uncomfortable position, but he may carry out the work by using the apparatus. Transferring and adjusting are carried out quickly.

In an advantageous application of the invention the apparatus comprises a set of transfer beams to be attached by locking to a transfer beam and to be moved in regard to the set of frame beams of the straightening table and locking elements for attaching the set of transfer beams to the transfer beam. In addition, the said transferring device has been organized to transfer the set of the transferring beams in regard to the transferring beam and the set of frame beams of the straightening table. In this case the set of transferring beams may be moved with one and the same transferring device as the transferring beam. While the transferring beam is not attached to the frame beam, that is, the locking elements mentioned first are unlocked, and the locking elements mentioned second are locked both the set of transferring beams and the transferring beam attached to it are moved with the transferring device. While the transferring beam has been attached by means of locking elements mentioned first to the frame beam and the locking elements mentioned second are unlocked, only the set of transferring beams is moved while the transferring device is used. In this case the set of transferring beams may be used for tasks related to straightening of the car body.

DESCRIPTION OF THE DRAWINGS

Next, the invention will be explained in more detail with reference to the accompanying drawings, in which.

Figure 1:
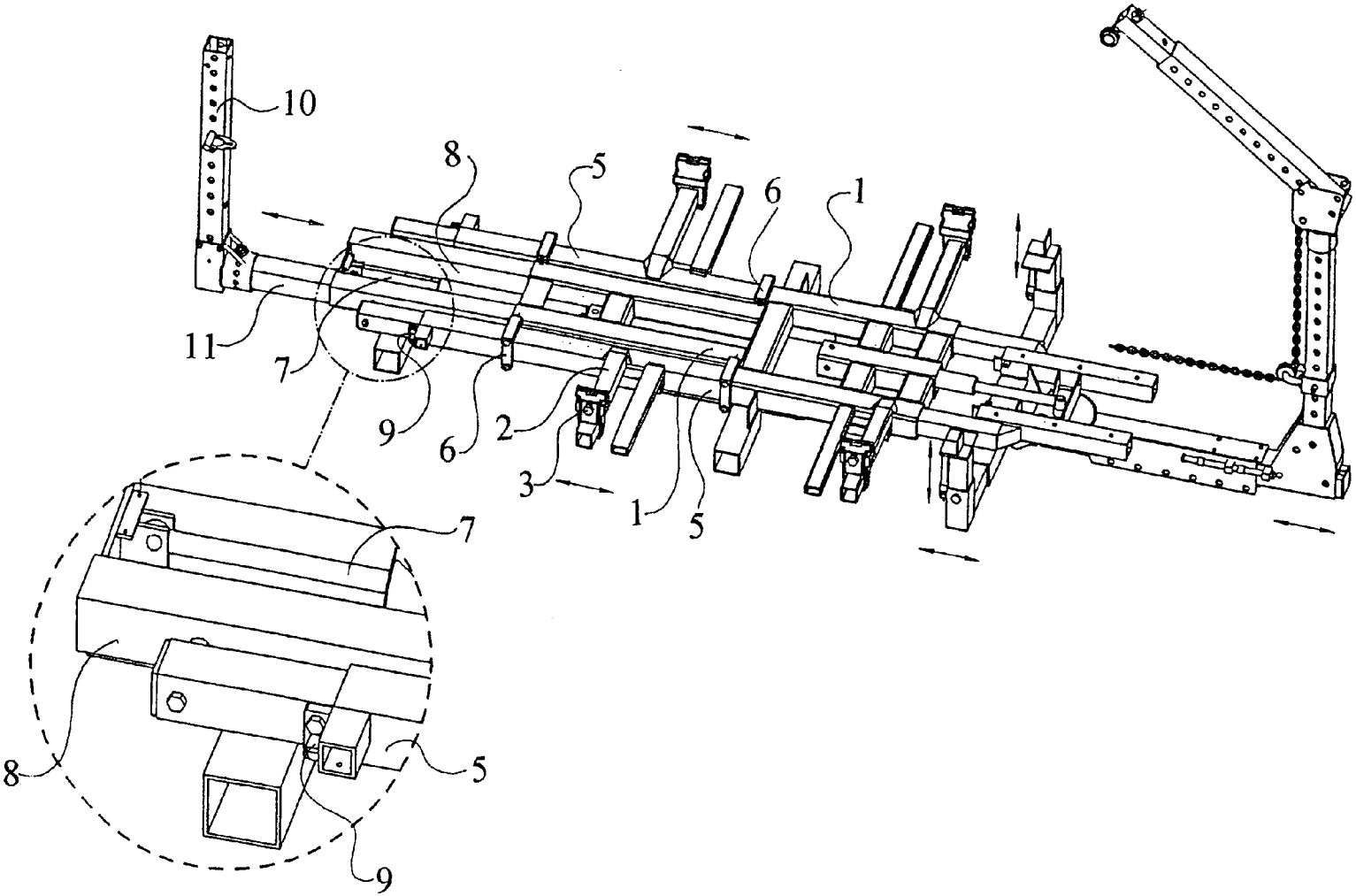
FIG. 1 illustrates an application of a straightening bench of a car body and an apparatus in accordance with the invention related to it viewed inclined from above and a magnified detail of the figure.

The straightening bench of a car body in accordance with figures comprise a straightening table and its set of frame beams 1, locking elements 2, 3 for attaching a car 4 to the set of frame beams, a transfer beam 5 to be attached movably to the frame beam 1 of the straightening table, locking elements 6 for attaching removably the transfer beam to the frame beam and a transferring device 7 for transferring the transfer beam in regard to the frame beam. There are transfer beams with their locking elements on both sides of the set of frame beams. The transfer beams reach partly inside the outer beams of the set of frame beams.

In this application the locking elements are arm like parts attached to a frame beam, which arm like parts are mainly U-shaped and the locking bolts are placed between the base part and the branches. The locking bolts reach sidewards and from there they may be opened or tightened with ease. While the locking bolts are unlocked the transfer beam may easily be moved along the direction of the frame beam and the locking elements support the transfer beam during the transfer.

The attaching elements comprise one or several attaching beams 2 attached to a transfer beam, and a fixing part 3 movably attached to the attaching beam. The fixing part is movable in the vertical direction of the attaching beam and in the direction of the width of the car and it may be attached to a desired point in a recognized way itself. A part of the attaching elements and, in this application, the attaching elements on the right side, have been fixed permanently to the set of frame beams.

The apparatus comprises also a set of transfer beams 8 movable in regard to the set of frame beams of the straightening table and to be locked to the transfer beam and locking elements 9 for attaching the set of transfer beams to the transfer beam 5. In addition, the transfer device 7 has been organized to transfer the set of transfer beams in regard to the transfer beam and the set of frame beams of the straightening table. The set of transfer beams reaches partly inside the set of frame beams and the beam of the set of transfer beams, which is located at the point of the transfer beams reaches partly inside the transfer beam. The bolts functioning as locking devices 9 have been attached to a projection made to the transfer beam and by means of these locking bolts the transfer beam may be attached to the set of transfer beams while desired.

The transferring device 7 is a hydraulic cylinder, which has been attached to the set of frame beams and to a transfer beam.

The apparatus illustrated in the figures comprises also a straightening tower 10, which has been attached to the set of transfer beams by means of the straightening beam 11. The straightening beam may be attached in a recognized way to the set of transfer beams by a bolt lock. While there are openings for the attachment in the straightening beam in a distance from each other, the straightening tower may easily be mounted to a desired distance from the straightening table and the car body on it.

A car is fixed to the straightening table by bringing it on the straightening table and attaching the fixing parts 3 illustrated on the right in the FIG. 1 to the attaching points of the car. The first locking elements 6 are unlocked at the time and the second locking elements 9 are locked. Next the transfer beam 5 and the attaching beam 2 and the fixing part 3 connected with it are moved in the direction of the frame beam 1 and supported by the locking elements 6 to the desired point of the car that is to the attaching points. After this the transfer beam is attached with the locking elements 6 to its place and the fixing part 3 is attached to its place. While the first locking elements 6 are locked and the other locking elements are unlocked, the transfer beam 5 with its attaching elements 2, 3 is attached to the frame beam, but the set of transfer beams may freely be transferred in regard to the transfer beam and the set of frame beams.

In case the attaching points of a car are situated in different sides at the same points the transfer of the transfer beams may be carried out simultaneously on the both sides. It is also possible to transfer the transfer beam and the attaching elements first on one side of the straightening table and only after that on the other side. While the attaching points in a car are situated at different points, the work and at least it's finishing phase is carried out in different time on different sides.

Figure 2:
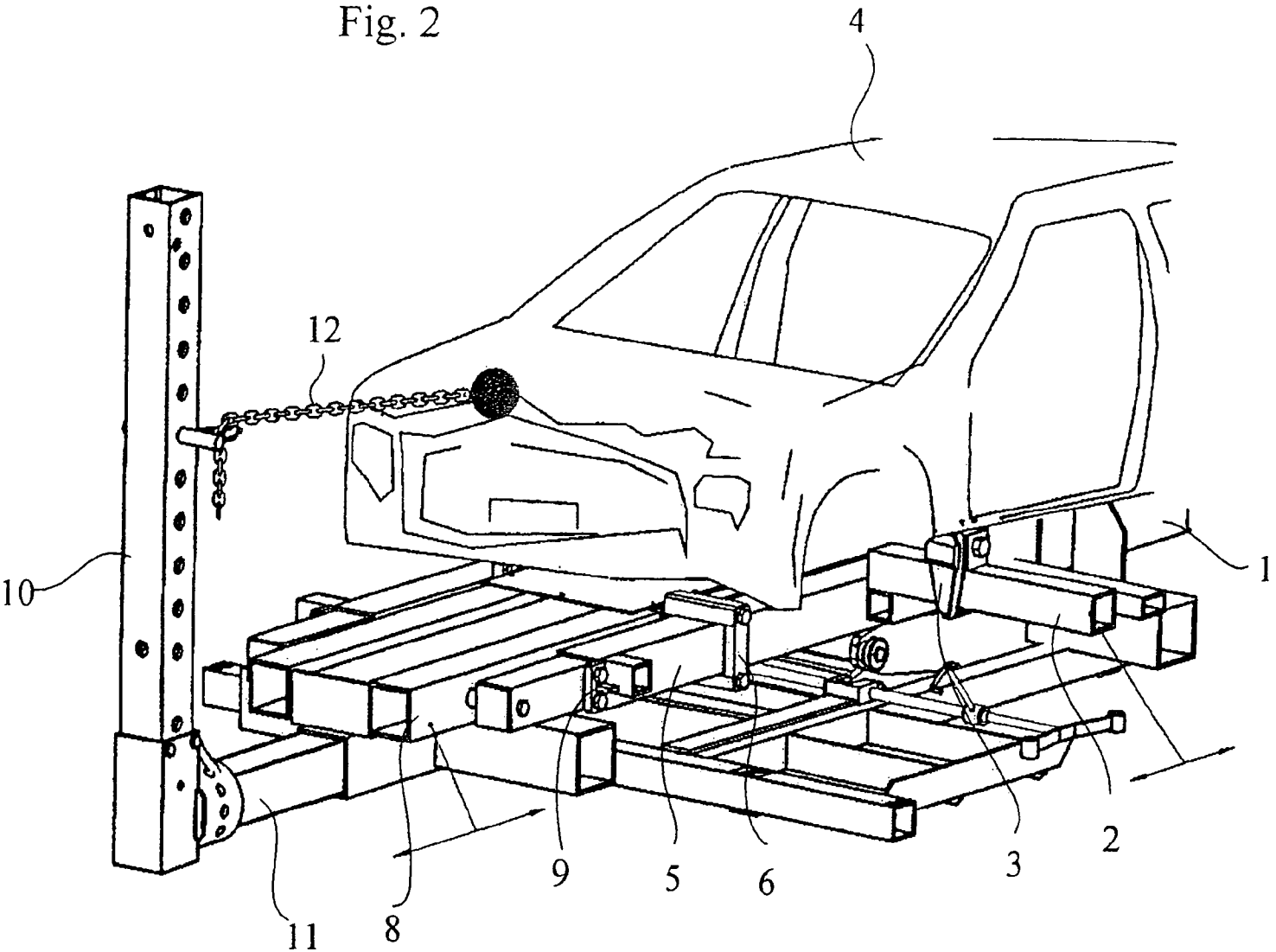
FIG. 2 illustrates a straightening bench of a car body in accordance with FIG. 1 to which a car has been fixed, viewed inclined from behind.

The set of transfer beams is used in the straightening work of a car body in accordance with FIG. 2 by attaching the straightening beam 11 and the straightening tower 10 to the set of transfer beams. In this case the locking elements 9 between the transfer beam and the set of transfer beams are unlocked. There is a straightening tool 12 attached in a recognized way to a desired place and to a desired position to the straightening tower and to the car body, which straightening tool is a chain in the figure. By means of a hydraulic cylinder 7 the set of transfer beams is moved and the chain gets tighter and it may be utilized in the straightening work.

The invention is not limited to the presented advantageous application but it can vary within the frames of the idea of the invention formed in the claims.

The invention claimed is:

1. A straightening bench of a car body apparatus, comprising:

a straightening table comprising a set of frame beams, attaching elements for attaching a car to the set of frame beams, wherein at least a part of the attaching elements are movably attached to the set of frame beams for attaching cars of various sizes to the straightening table, a transfer beam movably attached to the frame beams of the straightening table, wherein a part of the attaching elements is attached to the transfer beam, locking elements adapted to removable attach the transfer beam to the frame beams, and a transferring device adapted to move the transfer beam relative to the frame beams.

2. An apparatus in accordance with claim 1, which apparatus comprises a set of transfer beams movable relative to the set of frame beams of the straightening table and locked to the transfer beam, locking elements for attaching the set of transfer beams to the transfer beam, and the said transferring device has been arranged to transfer the set of transfer beams relative to the transfer beam and the set of frame beams of the straightening table.

3. Apparatus in accordance with claim 2, further comprising a straightening tower attached to the set of transfer beams.

4. An apparatus in accordance with claim 1, in which the transferring device has been attached to the set of frame beams and the set of transfer beams.

5. An apparatus in accordance with claim 1, in which the transferring device is a hydraulic cylinder.

6. An apparatus in accordance claim 1, in which the attaching elements comprise one or several attaching beams attached to the transfer beam and a fixing part attached movably to the attaching beam.

7. A car body straightening bench apparatus comprising:

a straightening table comprising a set of frame beams, attaching elements for attaching a car to the set of frame beams, wherein at least a part of the attaching elements are movably attached to the set of frame beams for attaching cars of various sizes to the straightening table, a transfer beam movably attached to the frame beams of the straightening table, wherein a part of the attaching elements is attached to the transfer beam, locking elements adapted to removable attach the transfer beam to the frame beams, and a transferring device adapted to move the transfer beam relative to the frame beams, wherein the transferring device comprises a hydraulic cylinder.

* * * * *